US009573735B2

(12) United States Patent
Tamarit Rios

(10) Patent No.: US 9,573,735 B2
(45) Date of Patent: Feb. 21, 2017

(54) CROWN CAP

(71) Applicant: DESARROLLOS TAMARIT PLAZA SL, Puzol (Valencia) (ES)

(72) Inventor: Ramon Tamarit Rios, Puzol (ES)

(73) Assignee: DESARROLLOS TAMARIT PLAZA SL, Puzol (Valencia) (ES)

( * ) Notice: Subject to any disclaimer, the term of this patent is extended or adjusted under 35 U.S.C. 154(b) by 0 days.

(21) Appl. No.: 13/995,046

(22) PCT Filed: Jun. 14, 2013

(86) PCT No.: PCT/ES2013/070389

§ 371 (c)(1),
(2) Date: Jun. 17, 2013

(87) PCT Pub. No.: WO2014/198967

PCT Pub. Date: Dec. 18, 2014

(65) Prior Publication Data

US 2016/0137358 A1 May 19, 2016

(51) Int. Cl.

| | |
|---|---|
| ***B65D 51/24*** | (2006.01) |
| ***B65D 41/42*** | (2006.01) |
| ***B65D 41/44*** | (2006.01) |
| ***B67B 7/16*** | (2006.01) |
| ***B65D 41/00*** | (2006.01) |

(52) U.S. Cl.

CPC ..... *B65D 41/42* (2013.01); *B65D 41/44* (2013.01); *B65D 51/24* (2013.01); *B65D 41/00* (2013.01)

(58) Field of Classification Search

CPC ..... B65D 2543/00092; B65D 51/24; B65D 51/243; B65D 41/42; B65D 41/44; B67B 7/16

USPC ..... 220/309.1, 310.1; 215/305

See application file for complete search history.

(56) References Cited

U.S. PATENT DOCUMENTS

| | | | | | |
|---|---|---|---|---|---|
| 1,174,898 | A | * | 3/1916 | Robinson | B65D 51/243 215/305 |
| 1,497,545 | A | * | 6/1924 | Clark | B65D 51/243 215/302 |
| 1,978,272 | A | * | 10/1934 | Lawrence | B65D 51/243 215/305 |
| 2,003,594 | A | * | 6/1935 | Johnson | B65D 51/243 40/311 |
| 3,281,001 | A | * | 10/1966 | Robert | B65D 41/42 215/254 |

* cited by examiner

*Primary Examiner* — Fenn Mathew
*Assistant Examiner* — Andrew T Kirsch
(74) *Attorney, Agent, or Firm* — Sughrue Mion, PLLC

(57) ABSTRACT

A crown cap, configured based on a sheet with a circular body perimetrally presenting, after being adjusted to the rim of the mouth of a bottle, a plurality of folds. The sheet has an extension that extends from the circular body and a first transverse folding line to determine a folded arm with two sections, an upper, external section that extends from the circular body followed by a lower, internal section, located between the external or front section and the bottle. The extension also has a continuous cut on the external section that determines a flap with an inverted U-shaped surface, the continuous cut allowing the flap to bend out of a plane of the external section so that during removal of the cap from the bottle, a distal end of the flap engages an area where the extension extends from the circular body.

15 Claims, 4 Drawing Sheets

CROWN CAP

CROSS REFERENCE TO RELATED APPLICATIONS

This application is a National Stage of International Application No. PCT/ES2013/070389, filed on Jun. 14, 2013, the contents of all of which are incorporated herein by reference in their entirety.

OBJECT OF THE INVENTION

The invention, crown cap for bottles of the type constituted by a metal plate, although it could be made of another material, presents the particularity of having a structural configuration that favors the opening operation of the bottle by means of the removal of the cap without requiring an opener.

The field of application of the present invention is encompassed within the sector of the industry dedicated to the manufacturing of caps, specifically focusing on the scope of crown-type caps.

BACKGROUND OF THE INVENTION

Crown-type bottle caps are broadly known, an opener being necessary in the majority of the cases to extract them from the bottle, given that they are adjusted on the rim thereof in its entire perimeter. However, to avoid using the opener, there are some types of crown caps that have means to open them manually, as is the case of the present invention.

However, and as a reference to the current state of the art, it should be noted that, even though different types of crown caps that allow the opening without using an opener are known, the existence of a cap presenting technical, structural, and constitutive characteristics similar to the one being described herein, as claimed, is not known, at least by the applicant.

DESCRIPTION OF THE INVENTION

Thus, the crown cap object of the present invention, preferably constituted based on a metal plate or sheet, but not limited thereof, given that it may be manufactured of other materials such as plastic, which is configured based on a circular body perimetrally provided with a plurality of folds generated for its adjustment to the rim of the mouth of a bottle, having a lateral extension that stretches from the edge of said circular body and determines a folded arm when folded, which constitutes the manual opening means of the cap.

Therefore, a first object of the present invention is a crown cap according to claim 1.

Specifically, the aforementioned extension presents a continuous cut that determines a flap with an inverted U-shaped surface, and preferably with a perimeter reinforcement rib along the sides of the flap, which purpose is to support the triangle formed by lifting said arm, and which lifting will contribute to the separation of the inverted U-shaped surface of the flap, which will stand against the rim or base of the cap, and will lift the set to separate the cap from the bottle. Weakening points or lines may be arranged at both sides of said cut or flap that contribute to the folding of the external section to form the triangle. The inverted U-shaped cut or flap presents two lateral sides and one upper side, being joined to the external section by a side opposite to said upper side. The lateral sides may be parallel or non-parallel, that is to say, such that the cut or flap presents a square or rectangular, or even trapezoidal, shape. Likewise, the cut or flap may have other shapes equivalent to the one being described, such as a V-shape, for example.

Likewise, the lateral extension of the cap presents a weakening line that remains in the internal or rear part of the arm when folded, in contact with the bottle, and when the arm is lifted, it allows the easy folding of the extension, creating the three sides of the triangle along the cut or flap with the inverted U-shaped surface.

In addition, the aforementioned folded arm or extension may also have longitudinal ribs in the upper and lower parts of the weakening line described above, which serve to guarantee the rigidity of the entire body when folding said area. The cut or flap may likewise present perpendicular or non-perpendicular reinforcement ribs on the upper side thereof.

Therefore, the crown cap is configured based on a sheet with a circular body that perimetrally presents a plurality of folds after being adjusted to the rim of the mouth of a bottle, said sheet comprising an extension that arises from the circular body and comprises a first transverse folding line to determine a folded arm with two sections, an upper, external, or front section, and a lower, internal, or rear section located between the external or front section and the bottle; and a continuous cut on the external or front section of the extension that determines a flap with an inverted U-shape surface.

Based on said configuration, by lifting the free extremity of the extension or arm folded at the first transverse folding line to separate the cap and open the bottle, the cut or flap with an inverted U-shape surface is separated from the upper or external section of the arm, ceasing to be coplanar as a consequence of the deformation of said external or upper section, preferably caused by weakening or folding points or lines made in the upper or external section at both sides of the flap or cut. Likewise, the upper said of said flap becomes a supporting point or area on the rim of the cap in the mouth of the bottle.

Said weakening or folding points or lines, which may be arranged at the external or upper section or at the internal or lower section, cause the folding of the sections at said points or lines when lifting the arm, creating a triangle alongside the flap, which upper side comes into contact with, as mentioned above, the rim of the cap adjusted to the mouth of the bottle. The surface of the flap comes into contact with said rim at an angle between 30° and 60°, more preferably as closely as possible to approximately 45°.

On the other hand, and according to another characteristic of the invention, a tear-shaped curved-convex protuberance has been envisaged in the upper part of the circular body of the cap, presenting several ribs in its interior that are in contact with the starting point of the lateral extension. This way, by lifting the arm of the extension making the U-shaped cut stand on and exert a force on the starting point of the extension, said tear collapses, contributing to the separation of the lateral folds of the cap, and therefore, to an easy opening of the cap in combination with the lifting of the arm of the extension.

Lastly, the cap may include two small transverse cuts in opposite sides of the perimeter of the circular body, which facilitate the final opening of the cap after lifting the lateral arm, exerting the force of the inverted U-shaped cut on the starting point of the extension, and finally collapsing the tear in the upper part of the cap to favor the folding of the cap in said two opposite points of the perimeter.

DESCRIPTION OF THE DRAWINGS

To supplement the description being made, and with the purpose of aiding a better comprehension of the characteristics of the invention, a set a illustrative rather than limitative figures is attached to the present specification.

Figure number 1 shows a plant view of an example of an embodiment of the crown cap, object of the invention, represented in a fully deployed position before being placed.

Figure number 2 shows a perspective view of the example of the crown cap, according to the invention, shown in the previous figure, represented in this case with the lateral extension partially folded.

Figure number 3 shows an elevated view of the enlarged detail of the lateral extension of the cap of the invention, represented in the extended position.

Figure number 4 shows a perspective view of the example of the crown cap, according to the invention, shown in FIGS. 1 and 2 once again, represented in this case with the lateral extension in the folded position, forming the folded arm, and with perimeter of the circular body in the folded position as well, as it would look when adjusted to the rim of the mouth of a bottle.

Figure 4:
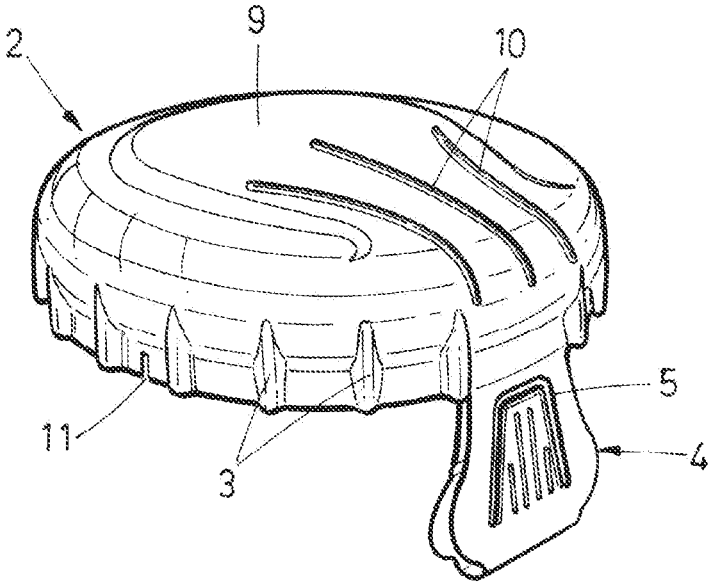
Figure 5:
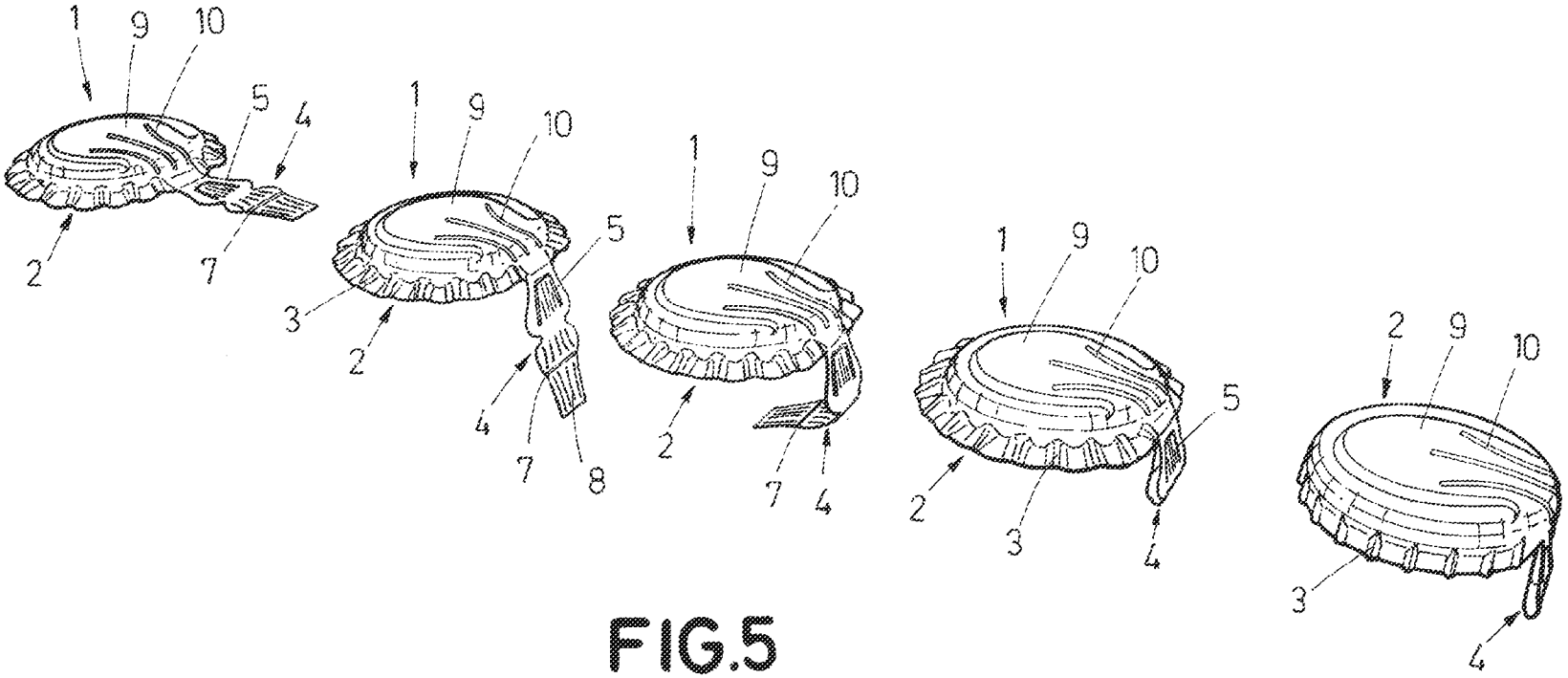

FIG. 5 shows the development of the cap from its position prior to assembly (FIG. 1), until its assembly on the bottle (FIG. 4).

Figure 6:
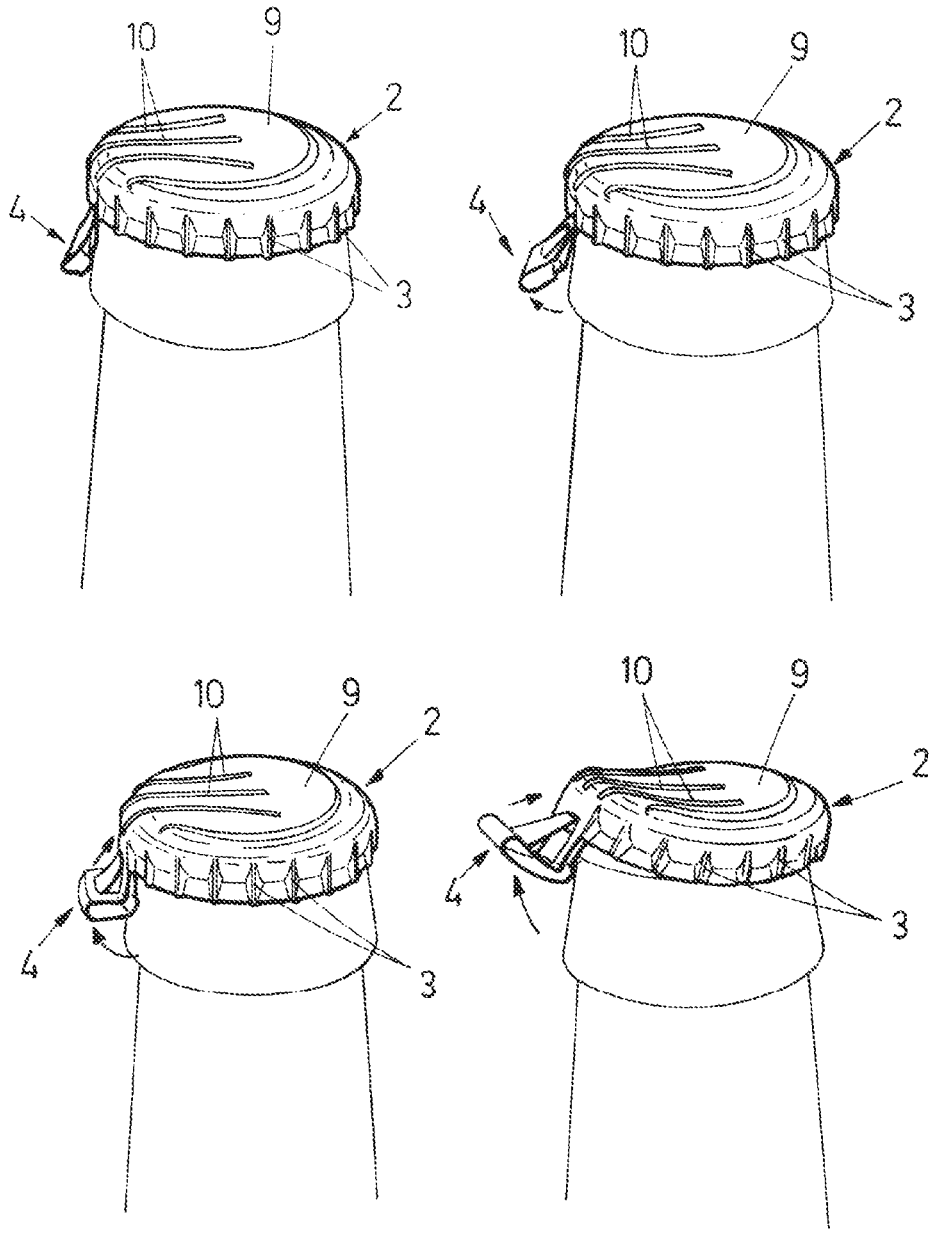

FIG. 6 shows the opening process of the cap object of the invention.

PREFERRED EMBODIMENT OF THE INVENTION

Based on the aforementioned figures, a preferred rather than limitative example of an embodiment of the crown cap object of the invention is described below.

Thus, as shown in said figures, the cap (1) in question is configured based on a circular body (2) which, in a conventional from, perimetrally presents a ring area with a plurality of folds (3) for its adjustment to the rim of the mouth of a bottle after installing the cap on the mouth of the bottle, with the particularity that it has a lateral extension (4) arising from the edge of said circular body designed to be folded, thus determining a folded arm that will constitute the component to allow the opening of the cap.

Said lateral extension (4) is divided into two sections, upper (4*a*) and lower (4*b*), separated by a transverse folding line (4*c*), where they are folded to form the aforementioned arm, such that the upper section (4*a*) is located in the external or front part of the cap, and the lower section (4*b*) on the internal or rear part thereof, said lower, internal, or rear section (4*b*) being specifically located between the bottle and the upper, external, or front section (4*a*).

In the upper, external, or front section (4*a*) of this extension (4), there is an inverted U-shaped cut (5) with a reinforcement rib (6) going along the edge of said cut. Said inverted U-shaped cut (5) is specifically joined to the extension (4) by one of its sides, and the other three sides of the inverted U (5) are separated from said extension (4), though coplanar with the same prior to being used. The upper side of the inverted U, perpendicular to the other two sides of said U, constitutes the supporting side that will cause the opening of the cap, as will be explained below.

Likewise, the lower, internal, or rear section (4*b*) has a weakening line (7) that is also transverse, which is in contact with the bottle, there being longitudinal ribs (8) above and below said weakening line (6) intended to provide rigidity to the entire arm when the lateral extension (4) is folded.

On the other hand, and in the upper side of the cap (1), a tear-shaped curved convex protuberance (9) has been envisaged in the central area of the circular body (2), which presents several ribs (10) in its interior located in contact with the starting point of the lateral extension (4).

Lastly, and in an optional manner, the cap (1) has two cuts (11), made on the edge in opposite sides of the perimeter ring area of the circular body (2), to facilitate the opening of the cap by opening it when the arm is lifted.

Figure 1:
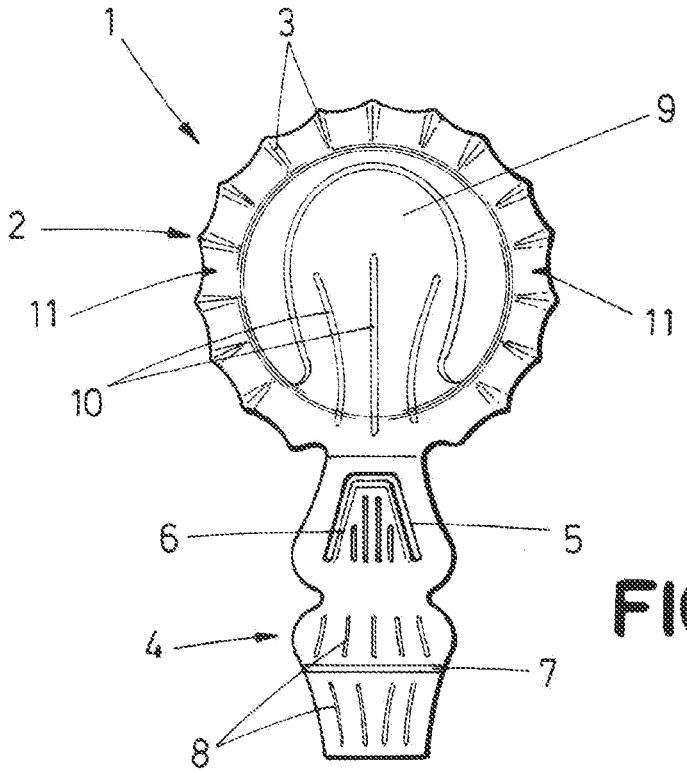
Figure 2:
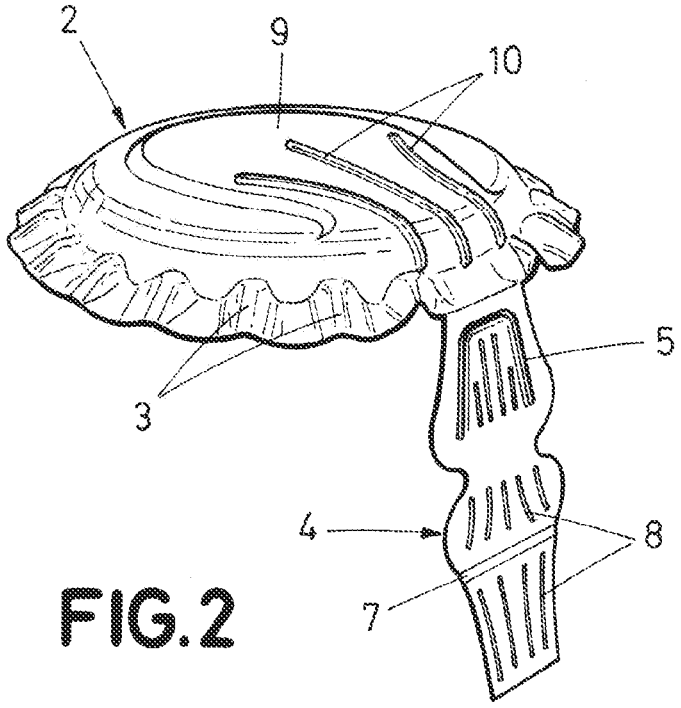
Figure 3:
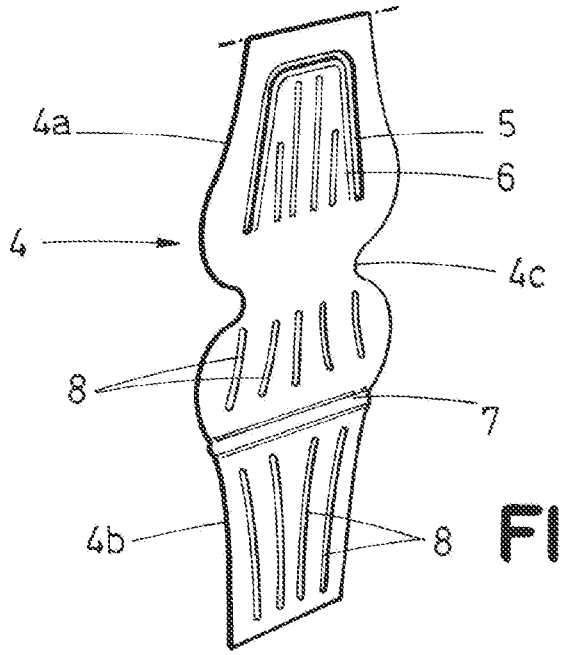

FIG. 1 shows the cap object of the invention prior to its arrangement and closing on the mouth of a bottle. Said figure shows the extension (4) prior to being folded with the two sections, upper, front, external (4*a*), and lower, front, internal (4*b*), as well as the rest of the components of the cap. FIG. 2 shows the cap, prior to its assembly on the bottle, with the extension (4) arranged perpendicularly to the circular body of the cap. FIG. 3 shows a detail of the extension (4) and the two sections (4*a*, 4*b*) prior to their folding at the weakening line (4*c*) for the formation of the opening arm of the cap (1). On the other hand, FIG. 4 shows the cap (1) object of the invention already located on the mouth of a bottle, not shown, wherein the folds (3) of the cap adjusted on the bottle and the extension (4), forming the arm with the two sections (4*a*, 4*b*) folded on one another, can be observed. The development of the assembly of the cap on a bottle can be observed in FIG. 5.

It should be noted that the ribs arranged in the different parts of the crown cap, mainly as reinforcement elements, are important for the transmission of force and to obtain the opening of the cap, but it should be highlighted that the size and number thereof will depend on the material of the cap.

After locating the cap (1) on the bottle in the position of FIG. 4, simply proceeding with the following steps will be enough to proceed with the opening. These steps will cause the opening of the aforementioned cap and are shown in FIG. 6:

Lifting, preferably with the thumb while the rest of the fingers of the hand hold the bottle by its neck, the arm at the folding line (4*c*), such that the arm starts to pivot around its area of contact with the circular body of the cap. Said folding line cannot contain a square corner, given that the upward force shall be applied at that point, preferably with the thumb, to avoid cuts in said finger, due to which a curved line will be generated at said point.

The force exerted by the thumb on the weakening line (4*c*) of the extension, which in turn constitutes the lower extremity of the arm with the two folded sections (4*a*, 4*b*), caused two movements: on the one hand, the separation of the same plane of the three sides, lateral and upper sides, of the cut (5) with an inverted U-shaped surface (5) with respect to the upper, external, or front section (4*a*), and, in turn, the folding of the lower, rear, internal section (4*b*) at the folding line (7). The separation of the three sides of the cut (5) from the upper section (4*a*) may be favored by the arrangement of weakening or folding points, which may become weakening or folding lines (not shown), arranged in the external or front section (4*a*) at each side of the continuous cut (5). Thus, by lifting the arm of the extension (4) with the finger, the lower or internal section (4*b*) is folded at the folding line (7) and the upper or external section (4*a*) is folded at the aforementioned weakening points or lines, forcing the surface of the cut (5) and the external section (4*a*) to cease being coplanar.

The previous movements cause, thanks to the configuration of the aforementioned components of the cap and to the reinforcement ribs and folding or weakening lines incorporated to the different parts of the cap, the creation of a triangle shaped by the lower, rear, or internal section (4*b*) folded in two parts at the weakening line, together with front, external, or upper section (4*a*), also folded into parts forming two sides of the triangle, and the third side of the triangle formed by the inverted U-shaped surface (5) of the cut existing in the front, upper, or external section (4*a*).

The upper side making up the inverted U (5), together with the other two lateral sides parallel to one another and perpendicular to the upper one, separated from the external section (4*a*) in different planes, constitutes the supporting side of the triangle at the area of contact of the extension (4) with the circular body of the cap, at the rim of the cap, specifically on said area of contact, to thus generate the supporting point or area of said cut.

Once the side of the inverted U (5) stands on the front area, and continuing with the lifting of the arm preferably by the thumb, the force or pressure of said supporting side of the inverted U (5) on the contact or supporting area of the cap, causes the deformation of the circular body of the cap, and in turn, the transmission of the pushing force through the ribs (10) integrated in the curved-convex tear (9) arranged in the upper part of the cap, generating a collapse of said tear and the subsequent deformation of the cap, which enables the removal thereof from the mouth of the bottle, and therefore, the opening of the bottle.

The invention claimed is:

1. A crown cap, configured based on a sheet with a circular body perimetrally presenting, after being adjusted to the rim of the mouth of a bottle, a plurality of folds, wherein the sheet comprises an extension that extends from the circular body and comprises:

a first transverse folding line to determine a folded arm with two sections, an upper, external, or front section that extends from the circular body followed by a lower, internal, or rear section, located between the external or front section and the bottle; and a continuous cut on the external or front section of the extension that determines a flap with an inverted U-shaped surface, the continuous cut allowing the flap to bend out of a plane of the external or front section of the extension so that during removal of the cap from the bottle, a distal end of the flap engages an area where the extension extends from the circular body.

2. The cap according to claim 1, wherein the circular body comprises a tear-shaped curved-convex protuberance.

3. The cap according to claim 2, wherein the tear-shaped curved-convex protuberance comprises several ribs in contact with a starting point of the extension.

4. The cap according to claim 1, wherein said flap presents two lateral sides and an upper side, and is joined to the external or front section at an end opposite to the upper side of the flap.

5. The cap according to claim 1, wherein the upper, external, or front section comprises at least one reinforcement rib parallel to said continuous cut.

6. The cap according to claim 1, wherein the upper, external, or front section comprises longitudinal ribs.

7. The cap according to claim 1, wherein the internal or rear section comprises a second transverse folding or weakening line, dividing said section into two parts.

8. The cap according to claim 7, wherein the internal or rear section comprises longitudinal ribs to provide rigidity to the two parts of said section above and below the folding or weakening line.

9. The cap according to claim 1, comprising at least two weakening or folding points in the external or rear section, one at each side of the continuous cut or flap, to favor the folding of said section.

10. The cap according to claim 1, comprising two cuts at diametrically opposite sides of the cap and made on an edge or perimeter of the circular body.

11. The cap according to claim 1, wherein the distal end of the flap is configured to be positioned between the external, or front section and the bottle.

12. The cap according to claim 1, wherein, prior to bending the flap out of the plane of the external or front section of the extension, the flap is bordered along an entire perimeter of the flap by portions of the external or front section of the extension.

13. A crown cap closing a mouth of a bottle, comprising:

a circular body with a plurality of folds along a perimeter of the circular body;

an extension that extends from the circular body and comprises:

a first transverse folding line along which the extension is folded to define an upper, external section that extends from the circular body followed by a lower, internal section, located between the external or front section and the bottle; and a cut in the upper, external section that defines an inverted U-shaped flap, the cut allowing the flap to bend out of a plane of the upper, external section so that during removal of the cap from the bottle, a distal end of the flap engages an area where the extension extends from the circular body.

14. The crown cap according to claim 13, wherein the distal end of the flap is positioned between the upper, external section and the bottle.

15. The crown cap according to claim 13, wherein, during removal of the cap from the bottle, the flap, a remaining portion of the upper, external section, and a portion of the lower internal section form a triangular structure with a base portion configured to be engaged by a thumb to remove the cap from the bottle.

* * * * *